US009228806B2

(12) United States Patent
Pepka

(10) Patent No.: US 9,228,806 B2
(45) **Date of Patent: *Jan. 5, 2016**

(54) PROTECTIVE ARMOR PANELS

(75) Inventor: Charles F. Pepka, Renton, WA (US)

(73) Assignee: Renton Coil Spring Company, Renton, WA (US)

( * ) Notice: Subject to any disclaimer, the term of this patent is extended or adjusted under 35 U.S.C. 154(b) by 108 days.

This patent is subject to a terminal disclaimer.

(21) Appl. No.: 13/485,672

(22) Filed: May 31, 2012

(65) Prior Publication Data

US 2012/0285316 A1 Nov. 15, 2012

Related U.S. Application Data

(63) Continuation-in-part of application No. 12/028,660, filed on Feb. 8, 2008, now Pat. No. 8,211,814.

(51) Int. Cl.
*F41H 5/04* (2006.01)

(52) U.S. Cl.
CPC ..... *F41H 5/0457* (2013.01); *Y10T 29/49826* (2015.01)

(58) Field of Classification Search
USPC ..... 89/36.02, 913; 29/428
See application file for complete search history.

(56) References Cited

U.S. PATENT DOCUMENTS

| | | | | |
|---|---|---|---|---|
| 6,863,950 | B1 * | 3/2005 | Cunningham | 428/136 |
| 8,211,814 | B2 * | 7/2012 | Pepka | 442/134 |
| 2004/0229533 | A1 * | 11/2004 | Braekevelt et al. | 442/6 |

* cited by examiner

*Primary Examiner* — Lynda Salvatore
(74) *Attorney, Agent, or Firm* — Darren J. Jones; Lowe Graham Jones, PLLC

(57) ABSTRACT

Protective armor panels comprising a grid formed of a plurality of strips of material having a front edge, a back edge, and side surfaces and a sheet of material secured to the front surface of the grid are disclosed. The strips of material can be contoured to form an armor panel having virtually any arbitrary shape.

41 Claims, 8 Drawing Sheets

PROTECTIVE ARMOR PANELS

PRIORITY CLAIM

This application is a continuation in part of U.S. patent application Ser. No. 12/028,660 filed on Feb. 8, 2008 entitled PROTECTIVE ARMOR PANELS which is incorporated herein by reference in its entirety.

FIELD OF THE INVENTION

This invention relates generally to protective armor panels and more specifically to protective armor panels to absorb projectiles and projectile energy.

BACKGROUND OF THE INVENTION

Protective armor such as body armor has been used for many years to provide protection from various objects which can cause bodily harm, including projectiles such as bullets, pointed objects such as knives and swords, blasts and shrapnel generated by explosive devices and the like. In the past, protective armor was rigid and heavy while modern armor, such as that fabricated from aramid fibers, for example KEVLAR, is more flexible and lightweight. However, there is often a tradeoff in that armor that is more flexible and lightweight often provides less protection than armor that is rigid and heavy.

Therefore, there is a continuing need for protective armor that is lightweight and versatile but that also provides a high degree of protection.

SUMMARY OF THE INVENTION

Protective armor panels comprising a polymer layer having upper and lower faces generally forming a sheet and a plurality of metal strips each having an upper edge, a lower edge and side faces, said side faces being oriented generally traverse to the upper face of said polymer layer and positioned at least partially within the polymer layer, are disclosed.

In one embodiment, a first set of the plurality of metal strips are arranged on edge and parallel to one another with their side faces normal to the upper face of the protective armor panel and a second set of the metal strips are arranged on edge and parallel to one another and positioned interlocked with and transverse to the first set of metal strips with their side faces normal to the upper face of the protective armor. In an alternate embodiment, the protective armor panels contain one or more additional metal grids.

The metal grid of the protective armor panels can be made from various metals, including stainless steel, while the polymer layer can be made from various polymers, including thermoplastic polymers such as polycarbonate.

Functionally, the metal grid of the protective armor panels fragments the incoming bullet or other projectile to be stopped while the polymer layer absorbs and disburses the energy of the resulting fragments so that the fragments do not escape from but rather remain within the polymer layer. Thus, the invention provides protective armor panels with a number of notable advantages, including a high degree of protection and lighter weight than conventional armor panels constructed using metal sheets.

In other embodiments, the protective armor panels can include a metal grid without a polymer layer. The protective armor panels can include a single metal grid, or multiple stacked metal grids that can be offset from one another. With multiple offset metal grids, the effective space exposed between grid members can be smaller even with the same spacing between grid members of each grid. The protective armor panels can include a solid or substantially solid layer attached to either the front surface, the back surface, or both the front and back surfaces of the metal grid. This solid layer can be made of titanium, Kevlar, or any other suitable material.

The protective armor panels can be implemented without a polymer layer or a covering layer so that air or another fluid can pass through the protective armor panels. For example, the protective armor panels can be placed at the front of a vehicle over an air intake area and permit the vehicle to intake air while still maintaining some level of protection against incoming projectiles.

The protective armor panels of the present invention can be used in the construction of various items in which conventional armor panels are used, including vehicles such as cars and trucks, military equipment such as tanks, armored personnel carriers and the like, general purpose vehicles such as jeeps, body armor and structures such as storage sheds and other buildings.

BRIEF DESCRIPTION OF THE DRAWINGS

Preferred and alternative embodiments of the present invention are described in detail below with reference to the following drawings. These depict particular embodiments of the invention and are not intended to limit the scope of the invention as set forth in the claims. All of the drawings are schematics rather than precise representations and are not drawn to scale.

FIG. 1A is a top and partially sectional view of a protective armor panel while

DETAILED DESCRIPTION OF THE PREFERRED EMBODIMENTS

Figure 1A:
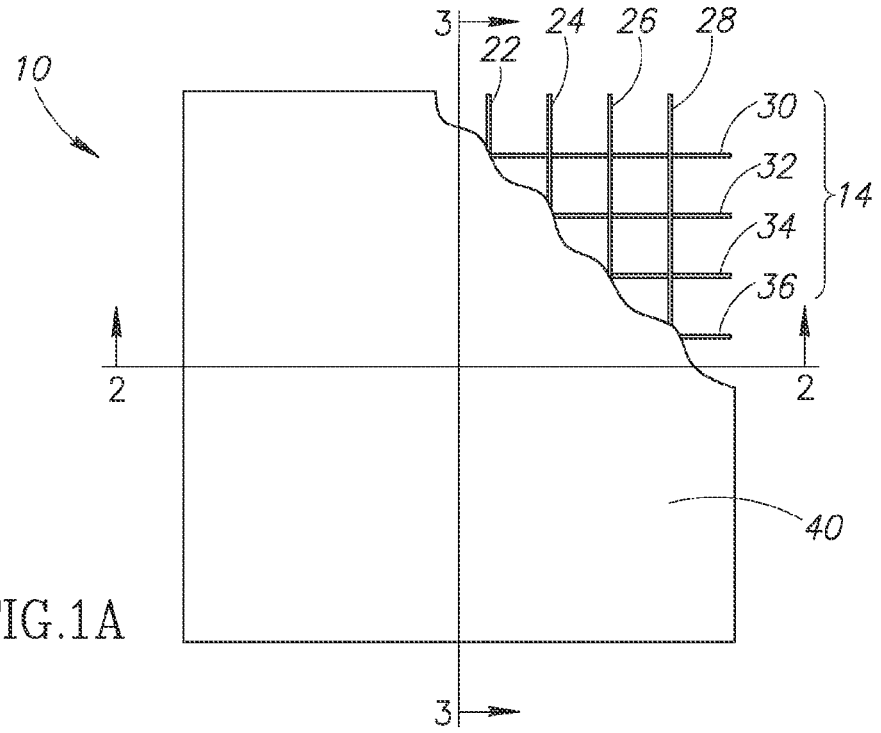
Figure 1B:
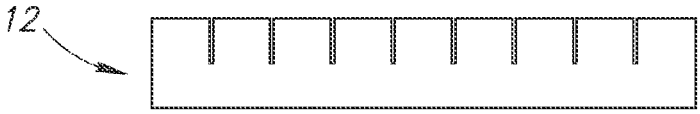
FIG. 1B is a side view of an individual metal strip used in protective armor panel, in accordance with the present invention.

Referring now to FIG. 1A, an embodiment of a protective armor panel 10 is shown that has a metal grid 14 comprising a plurality of metal strips and a polymer layer 40, which encloses the metal grid 14. In the metal grid 14, a first set of the metal strips (22, 24, 26 and 28 in the illustrated embodiment) are arranged on edge and parallel to one another with their side faces normal to the upper face of the protective armor panel 10. A second set of the metal strips (30, 32, 34 and 36 in the illustrated embodiment) are also arranged on edge, parallel to one another and positioned interlocked with and transverse to the first set of the metal strips (22, 24, 26 and 28 in the illustrated embodiment) with their side faces normal to the upper face of the protective armor 10 in order to form the metal grid 14. Alternatively, the first set of metal strips may be oriented at various transverse angles relative to the second set of metal strips. Furthermore, in some embodiments, the strips within a set of metal strips may not all be parallel to one another. FIG. 1B is a side view of an individual user protection metal strip 12 in the metal grid 14 of the armor panel 10. The polymer layer 40 is used to enclose the metal grid 14. In certain embodiments, the polymer layer 40 surrounds the metal grid 14 on all six sides.

Functionally, the metal grid 14 of the protective armor panels 10 fragments the incoming bullet or other projectile to be stopped while the polymer layer 40 absorbs and disburses the energy of the resulting fragments so that the fragments do not escape from but rather remain within the polymer layer. Thus, the protective armor panels 10 of the present invention provide a high degree of protection. Additionally, since the protective armor panels 10 of the present invention are constructed using metal strips embedded in a polymer as opposed to thick metal sheets, they are lighter in weight than conventional armor panels constructed using metal sheets.

Various metals can be used to construct the metal grid 14 used in the protective armor panels 10 of the present invention. Suitable metals include, for example, aluminum alloys, titanium and stainless steel, with stainless steel being preferred. In general, the metal used should have high tensile strength and hardness and is most commonly a "ballistic grade" metal. The individual metal strips used in the metal grid 14 can range from about ¼ inch to about ¾ inch in width and from about 0.035 inch to about 0.090 inch in thickness, while the spacing between parallel metal strips in the first set of metal strips (22, 24, 26 and 28 in the illustrated embodiment) and the second set of metal strips (30, 32, 34 and 36 in the illustrated embodiment) can range from about ⅛ inch to about ½ inch. The width, thickness and spacing of the individual metal strips as well as the length and number of the individual metal strips to be used in the protective armor panel 10 is determined by the size and shape of the protective armor panel 10 to be constructed, the caliber of the bullet or other projectile to be stopped and space and weight constraints. In general, as the caliber of the bullet or other projectile to be stopped increases, the thickness of the protective armor panel 10 increases, as does the thickness of the metal strips used in the metal grid 14. The thickness of the protective armor panel 10 can range from about 0.25 inch to about 1.5 inches. Preferably, the thickness of the protective armor panel 10 ranges from about 0.25 inch to about 0.75 inch.

Various polymers can be used in the polymer layer 40 of the protective armor panels 10 of the present invention. Suitable polymers include, for example, thermoplastic polymers such as polycarbonate (e.g., Lexan®). A preferred polymer is polycarbonate. The polymer used can be opaque, translucent or transparent, depending on the intended application. In general, the polymer used is most commonly a "ballistic grade" material. The length, width, and thickness of the polymer layer 40 is determined by the size and shape of the protective armor panel 10 to be constructed, the caliber of the bullet or other projectile to be stopped and space and weight constraints. In general, as the caliber of the bullet or other projectile to be stopped increases, the thickness of the polymer layer 40 increases.

It should be understood that more than one metal grid 14 can be used in the protective armor panels 10 of the present invention. Preferably, two metal grids are used together. The number of metal grids 14 to be used is determined by the caliber of the bullet or other projectile to be stopped and space and weight constraints. In general, as the caliber of the bullet or other projectile to be stopped decreases, the number of metal grids 14 increases to decrease the size of the resulting apertures between the stacked grids. Alternatively, when a single metal grid 14 is used (or only a few metal grids are used), this can be accomplished by decreasing the spacing between the metal strips in the metal grid 14. When multiple metal grids 14 are used, they are typically offset from one another to decrease open spaces in the protective armor panel 10 and thereby increase its protective ability. It should be understood that the ability to see through the protective armor panel 10 decreases as the number of metal grids 14 increases. Thus, while visibility through the protective armor panel 10 may be good when a single metal grid 14 is used, visibility through the protective armor panel 10 may be limited when two or more metal grids 14 are used. Additionally, as the thickness of the polymer layer 40 increases, visibility through the protective armor panel 10 also decreases. If desired, multiple protective armor panels 10 can be used for more energy absorption and to provide a greater degree of protection.

Various methods can be used to construct the protective armor panels 10 of the present invention. In one embodiment, the metal grid 14 is first assembled after which the polymer layer 40 is applied to the metal grid 14 using well-know injection molding techniques. In an alternate embodiment, the polymer layer 40 is prepared using well-know injection molding techniques and then machined to create grooves (see discussion of FIG. 5 below) for insertion of the metal grid 14. The assembled metal grid 14 can then be placed into and secured within the groove of the polymer layer 40.

Figure 2:
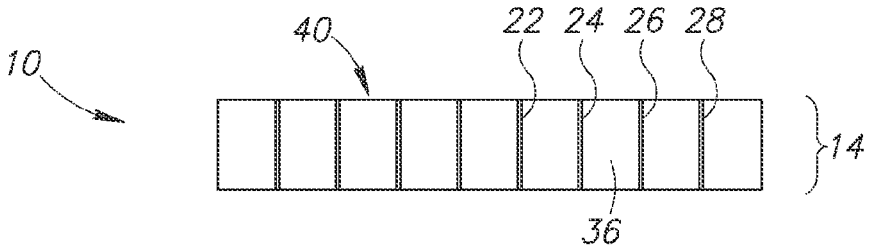
FIG. 2 is a cross-sectional elevation view of the protective armor panel shown in FIG. 1, in accordance with the present invention.

Referring now to FIG. 2, the embodiment of the protective armor panel 10 depicted in FIG. 1 is shown in a cross-sectional, elevation view in order to show the arrangement of the plurality of metal strips in the protective armor panel 10. As set forth above, the protective armor panel 10 includes the metal grid 14 comprising the plurality of metal strips and the polymer layer 40. The first set of the metal strips (22, 24, 26 and 28 in the illustrated embodiment) are arranged on edge and parallel to one another with their side faces normal to the upper face of the protective armor panel 10 while the second set of the metal strips (30, 32, 34 and 36 in FIG. 1) are also arranged on edge and parallel to one another and positioned interlocked with and transverse to the first set of the metal strips (22, 24, 26 and 28 in the illustrated embodiment) with their side faces normal to the upper face of the protective armor 10 in order to form the metal grid 14. In this cross-sectional view, the cut sections of all of the metal strips in the first set of the metal strips (22, 24, 26 and 28 in the illustrated embodiment) but only one of the side faces of the metal strip (36 in the illustrated embodiment) from the second set of the metal strips (30, 32, 34 and 36 in FIG. 1) can be seen.

Figure 3:
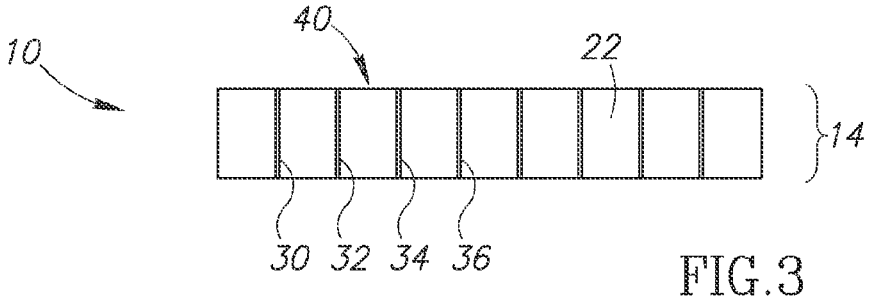
FIG. 3 is a second cross-sectional elevation view of the protective armor panel shown in FIG. 1, in accordance with the present invention.

Referring now to FIG. 3, the embodiment of the protective armor panel 10 depicted in FIG. 1 is shown in a side, elevation, cross-sectional view in order provide a different view of the arrangement of the plurality of metal strips in the protective armor panel 10. As set forth above, the protective armor panel 10 includes the metal grid 14 comprising the plurality of metal strips and the polymer layer 40. The second set of metal strips (30, 32, 34 and 36 in the illustrated embodiment) are arranged on edge and parallel to one another with their side faces parallel to the sides of the protective armor panel 10 while the first set of the metal strips (22, 24, 26 and 28 in FIG. 1) are also arranged on edge and parallel to one another and positioned interlocked with and transverse to the second set of the metal strips (30, 32, 34 and 36 in the illustrated embodiment) with their side faces normal to the upper face of the protective armor 10 in order to form the metal grid 14. In this cross-sectional view, the cut sections of all of the metal strips in the second set of the metal strips (30, 32, 34 and 36 in the illustrated embodiment) but only one of the side faces of the metal strip (22 in the illustrated embodiment) from the second set of metal strips (22, 24, 26 and 28 in FIG. 1) can be seen.

Figure 4:
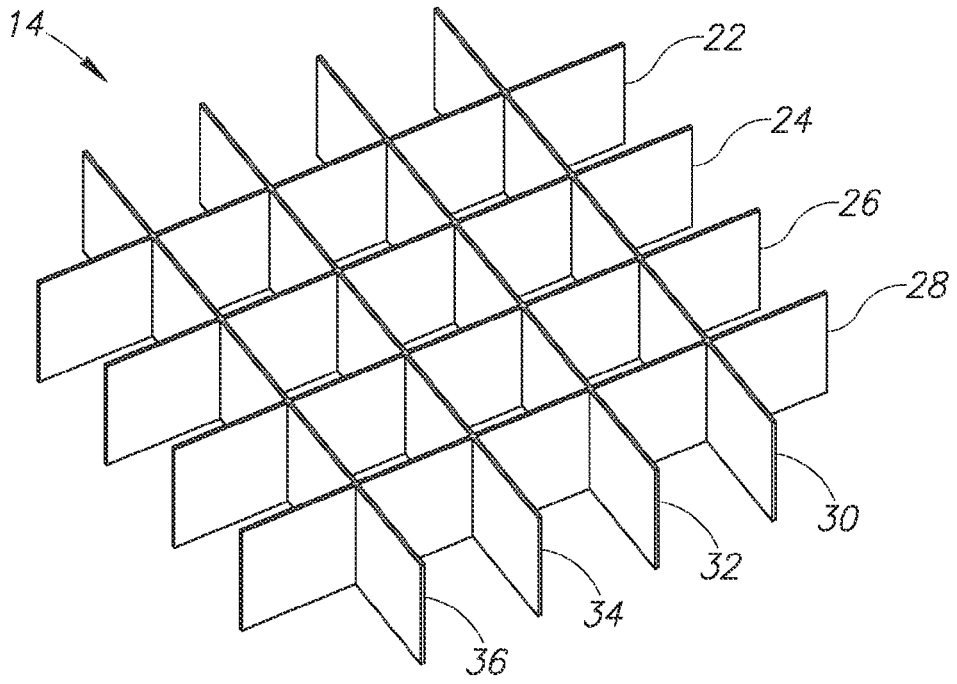
FIG. 4 is an isometric view of the metal grid of the protective armor panel shown in FIG. 1, in accordance with the present invention.

Referring now to FIG. 4, the metal grid 14 of the embodiment of the protective armor panel 10 depicted in FIG. 1 is shown in an isometric view in order to show the arrangement of the plurality of metal strips in the metal grid 14. The metal strips of the metal grid 14 are positioned on edge with their side faces normal to the upper face of the protective armor panel (not shown). The first set of the metal strips (22, 24, 26 and 28 in the illustrated embodiment) are arranged on edge and parallel to one another with their side faces generally normal to the upper face of the protective armor panel 10 while the second set of metal strips (30, 32, 34 and 36 in the illustrated embodiment) are also arranged on edge and parallel to one another interlocked with and transverse to the first set of the metal strips (22, 24, 26 and 28 in the illustrated embodiment) in order to form the metal grid 14. Alternatively, the first set of metal strips may be oriented at various angles relative to the second set of metal strips. Furthermore, in some embodiments, the strips within a set of metal strips may not all be parallel to one another.

Figure 5:
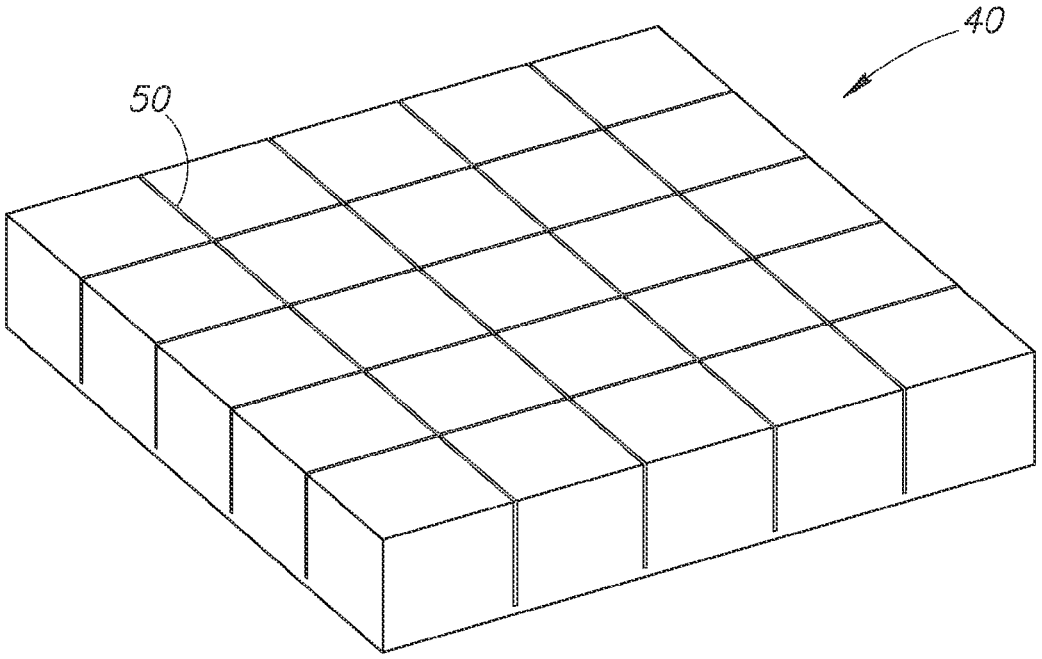
FIG. 5 is an isometric view of an alternate embodiment of a polymer layer for uses in a protective armor panel in which the polymer layer contains grooves for insertion of a metal grid, in accordance with the present invention.

Referring now to FIG. 5, an embodiment of the polymer layer 40 containing grooves 50 for insertion of the metal grid 14 (not shown) is shown in isometric view. In this embodiment, the polymer layer 40 is prepared using well-know injection molding techniques and then machined to create grooves 50 for insertion of the metal grid 14. The assembled metal grid 14 is then placed into and secured within the grooves 50 of the polymer layer 40 to form the protective armor panel 10.

Figure 6:
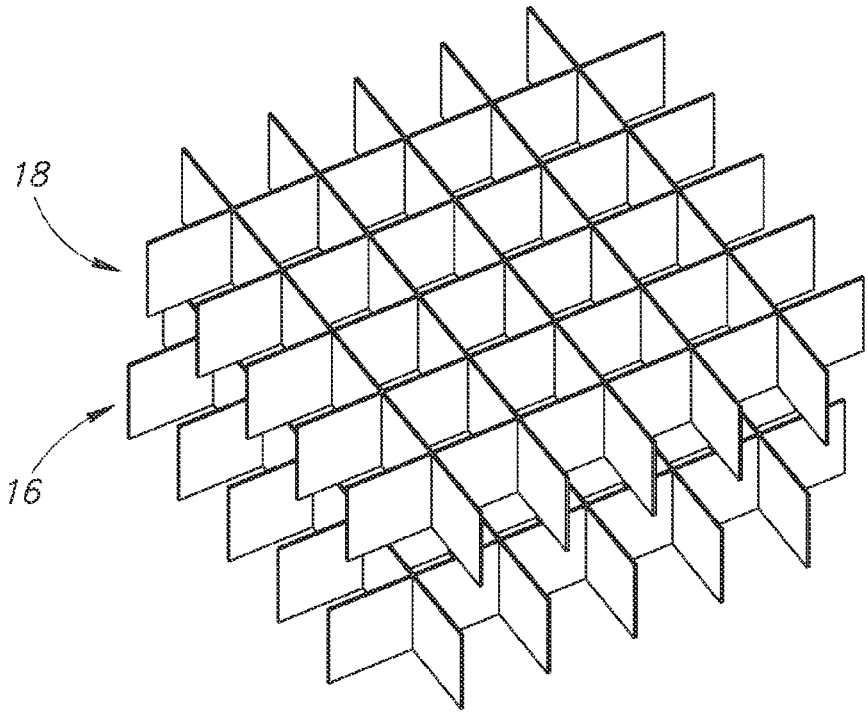
FIG. 6 is an isometric view of a multiple metal grid arrangement for use in a protective armor panel, in accordance with the present invention.

Referring now to FIG. 6, a multiple metal grid arrangement for use in the protective armor panel 10 of the present invention is shown in isometric view. In the illustrated embodiment, a first metal grid 16 and a second metal grid 18 are used. The possible arrangements of metal strips in each of the metal grids is the same as set forth above for the single metal grid 14. The first metal grid 16 and the second metal grid 18 are offset from one another to decrease open spaces in the protective armor panel 10 and thereby increase its protective ability.

Figure 7:
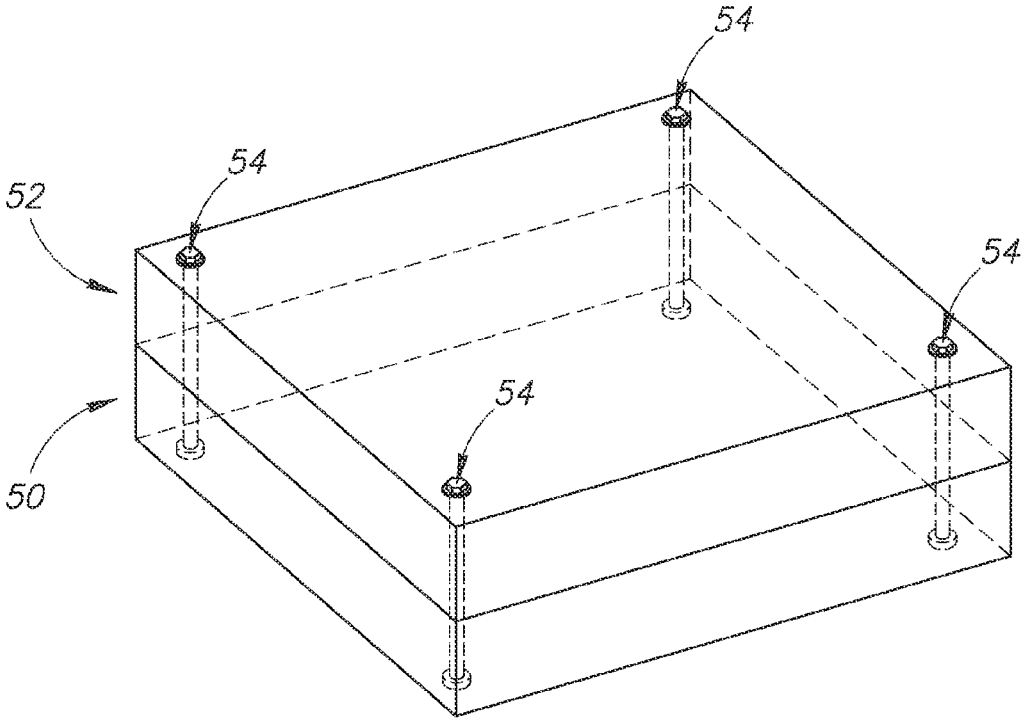
FIG. 7 is an isometric view of a multiple protective armor panel arrangement, in accordance with the present invention.

Referring now to FIG. 7, an embodiment utilizing multiple protective armor panels 10 is shown in isometric view. In the illustrated embodiment, a first protective armor panel 50 and a second protective armor 52 are used and connected using a bolt and nut arrangement 54. A multiple protective armor panel arrangement of this kind provides for more energy absorption and a greater degree of protection. Each of the protective armor panels 10 have the possible characteristics of the single protective armor panel 10 discussed above. However, the protective armor panels 10 in such a multiple grid arrangement do not need to be identical.

Figure 8:
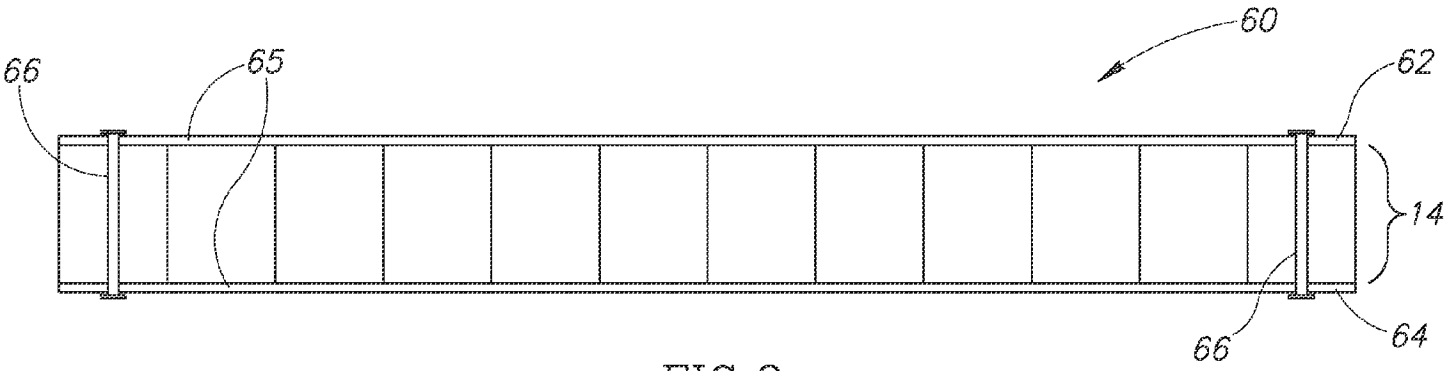
FIG. 8 is an end view of a protective armor panel having a metal grid, a front sheet of material and a back sheet of material on opposite sides of the protective panel in accordance with the present invention.

FIG. 8 illustrates a protective armor panel 60 according to embodiments of the present invention. The armor panel 60 can include a metal grid 14 similar to embodiments shown above, a front sheet 62 attached to a front side of the metal grid 14 and a back sheet 64 attached to a back side of the metal grid 14. (The front sheet 62 and back sheet 64 are referred to herein collectively as sheets 65.) The metal grid 14 can include a single metal grid 14, or it can include multiple, stacked or interwoven, metal grids 14, either offset or otherwise. The front sheet 62 and back sheet 64 can be held together with a fastener 66, such as a rivet, a bolt, a threaded fastener, or any other suitable type of fastener. The fastener 66 can engage a portion of the metal grid 14, or it can pass through a space between members of the metal grid 14. The protective armor panel 60 of this embodiment can omit a polymer layer or any other equipment between the members of the metal grid 14. In other words, the spaces between the members of the metal grid 14 can be empty. One or more of the sheets 65 can be made of titanium, Kevlar, stainless steel, or another suitable material. The front sheet 62 can be made of a different material than the back sheet 64 in any suitable combination, such as titanium/Kevlar, Kevlar/titanium, etc. In some embodiments, the sheets 65 are made from a material that is energy-absorbent to absorb energy from an incoming projectile. The choice of material for the sheets 65 can be made taking into consideration that the projectile will strike the front sheet 62 before being fragmented by the metal grid 14, and will strike the back sheet 64 after contacting the metal grid 14. In the case of a protective armor panel 60 having multiple metal grids, the panel 60 can include an intermediate sheet (not shown) between the metal grids 14.

In some embodiments, the protective panel 60 can include the front sheet 62 and the metal grid 14 only, the back sheet 64 and the metal grid 14 only, or with only the metal grid 14 (which may include multiple metal grids, offset or otherwise). In embodiments that do not include a front sheet 62, a back sheet 64, or an intermediate sheet, the metal grid 14 promotes airflow transverse to the armor panel 60, while maintaining a degree of armor protection. This can be used, for example, in front of a radiator or an air intake of a vehicle or another suitable application. In some embodiments, the sheets 65 can have holes spaced as needed throughout the protective armor panel 60 to provide airflow where it is needed and not elsewhere.

The protective armor panel 60 can be used in a variety of applications, such as for vehicles and installations. The protective armor panel 60 can also be used in body armor such as a vest or a helmet or another suitable piece of equippable body armor. The structure of the metal grid 14 can provide a more lightweight armor than some alternative armor types.

Figure 9:
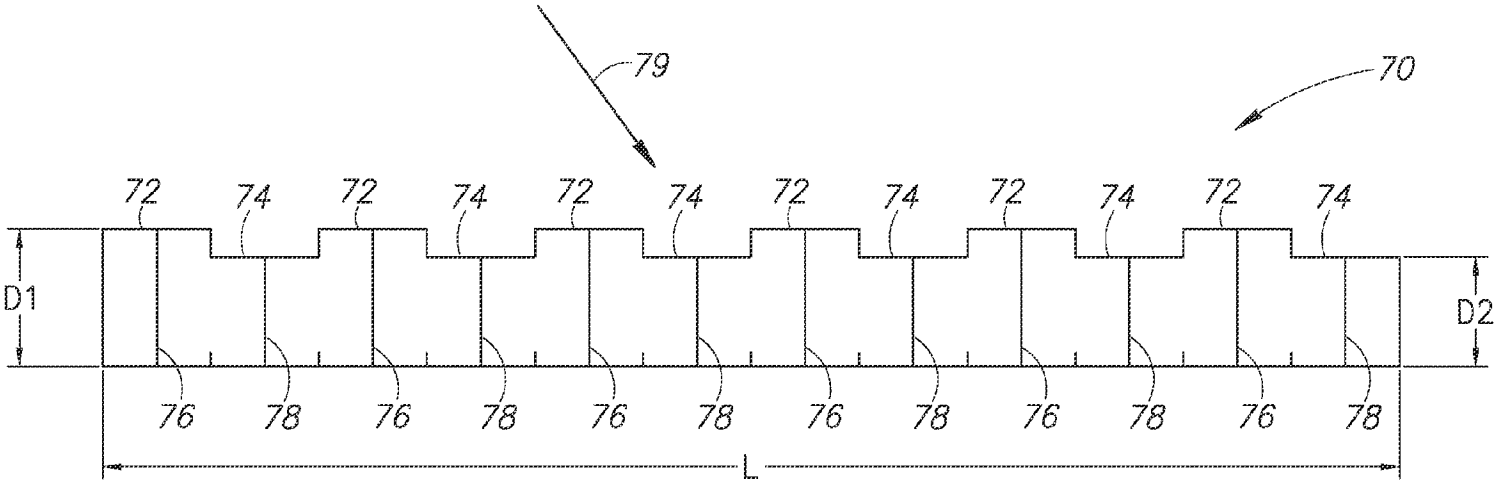
FIG. 9 is a side view of a metal strip having varying depths for use in a metal grid of a protective armor panel in accordance with the present invention.

FIG. 9 illustrates a strip 70 made of metal or another suitable material for use with a protective armor panel similar to those described and shown herein. As described above, the strip 70 can be a generally flat, straight piece of metal that can be combined with other, similar strips to form a protective armor panel. The strip 70 can have a length L, and a thickness that extends into the plane of the figure. The length L can be any suitable dimension as needed for a particular application, and the thickness is generally small, such as from 0.035 inch to about 0.090 inch. The strip 70 can have a first depth D1 in some points along the strip 70, and a second depth D2 at other points along the strip 70. The dimensions D1 and D2 can be any suitable dimension. For example, the first dimension D1 can be between ¼ and 1½ inch, and the dimension D2 can be between ⅜ inch and ½ inch. In other embodiments, the strip 70 can have any number of different depths at various points along the strip 70. The different depths give the metal strip 70 deep portions 72 and shallow portions 74.

The difference between dimensions D1 and D2 can vary as needed for a given application. The length of the deep portions 72 and of the shallow portions 74 can vary as well. The strip 70 of FIG. 9 shows an equal number of deep portions 72 and shallow portions 74, and the deep portions 72 have the same length as the shallow portions 74. In other embodiments, the number and size of the deep portions 72 and the shallow portions 74 can vary as needed for a given application. To form the metal grid, the strip 70 can cooperate with transverse strips, such as deep strips 76 and shallow strips 78, shown here edgewise and corresponding in position to the deep portions 72 and shallow portions 74, respectively. One edge of the strip 70 is irregular due to the deep portions 72 and shallow portions 74 and the opposite edge is flat. However, in other embodiments the strip 70 can have deep portions 72 and shallow portions on both sides of the strip 70.

In some preferred embodiments, the protective armor panel constructed from several strips 70 will have an irregular surface on at least one side of the panel. The irregular surface can help direct an incoming projectile in an advantageous manner relative to the armor panel. For example, suppose an incoming projectile such as a bullet approaches the strip 70 on the vector 79 having a transverse component parallel to the surface of the strip 70 and a normal component perpendicular to the surface of the strip 70. The irregular surface of the strip 70 caused by the deep portions 72 and shallow portions 74 causes the projectile to strike a side of a transverse deep strip 76. The transverse deep strip 76 absorbs most or all of the transverse component of the vector 79 and the projectile is directed substantially or completely normal to the armor panel. The projectile will then strike a back plate of Kevlar or another suitable material, or it will pass through a second grid as shown above in FIG. 6 which may be offset from the first grid. The projectile is more likely to strike a slat of the second grid, lose kinetic energy by fragmenting, and then embedding in a back plate.

In some embodiments, the grid formed by strips 70 having different depth regions can be used with a front plate as shown in FIG. 8. The front plate can include openings configured to receive the deep portions 72 of the irregular surface of the strip 70 and can sit against the shallow portions 74. Accordingly, the deep portions 72 can protrude from the front plate by any desired dimension. The protruding deep portions 72 can deflect an incoming projectile in the same manner as discussed above for the armor panel without a front plate by directing the projectile to pass into the armor panel generally normal to the panel, even when the projectile approaches the armor panel from an oblique angle such as vector 79.

In other embodiments, the front plate can sit against the deep portions 74, leaving a space between the front plate and the shallow portions 74. This space can be used for airflow through the armor panel. The front plate can be made of a material that can deflect or rupture when struck by an incoming projectile so that the projectile strikes a broad surface of the deep portion 72 and is directed to pass into the armor panel generally normal to the armor panel.

Figure 10A:
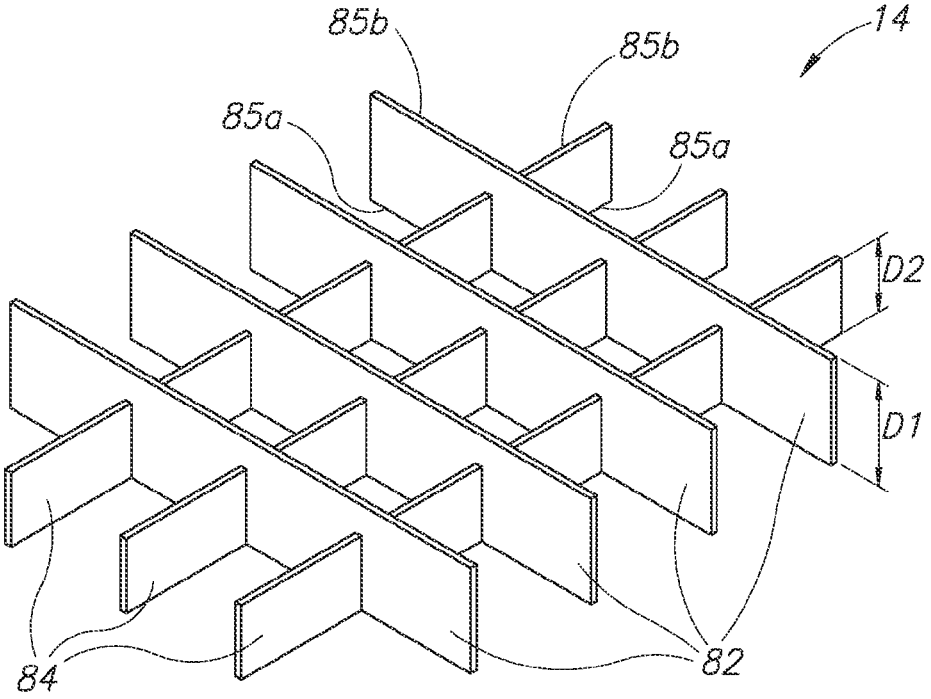
FIG. 10A is an isometric view of a grid having shallow strips and deep strips in accordance with an embodiment of the present invention.

FIG. 10A illustrates a grid 14 including strips having various depths. In some embodiments, the grid 14 includes deep strips 82 having a first depth D1 and shallow strips 84 having a second depth D2. The first depth D1 can be greater than the second depth D2. For example, the first depth D1 can be approximately 1½ inches, and the second depth D2 can be approximately ½ inch. The grid 14 can contain any number of strips having any number of different depths. For example, the grid 14 may include strips that each have a different depth. The strips can have a back edge 85*a* and a front edge 85*b*. The strips can be aligned with the back edge 85*a* aligned and the front edge misaligned due to the difference in depth. The grid 14 can therefore have an irregular surface that can direct a projectile along a more perpendicular path relative to the armor panel as described above. In other embodiments, the front edge 85*b* of the strips can be aligned and the back edge 85*a* can be misaligned to permit airflow over the shallow strips 84. In still other embodiments, the front edge 85*b* of some of the shallow strips 84 can be aligned with the front edge 85*b* of the deep strips 82 while the back edge 85*a* of other shallow strips 84 are aligned with the back edge 85*a* of the deep strips 82. In yet other embodiments, the front edge 85*b* and back edge 85*a* of some or all of the shallow strips 84 can be misaligned with the front edge 85*b* or back edge 85*a* of the deep strips 82. Accordingly, the grid 14 can have an irregular surface on the front side, the back side, or on both the front side and the back side of the grid.

Figure 10B:
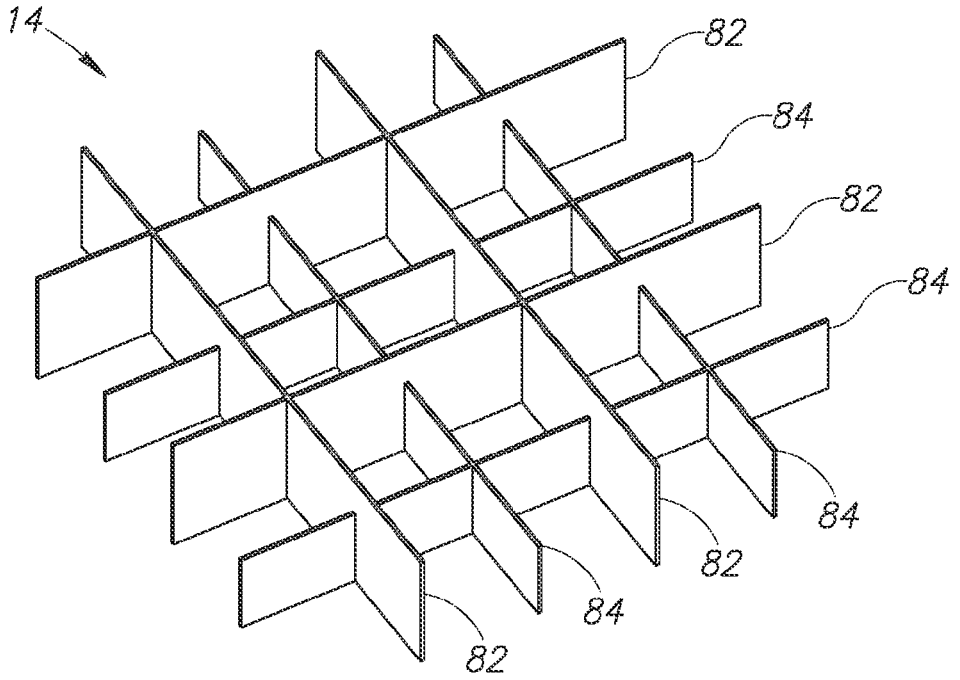
FIG. 10B is an isometric view of a grid having shallow strips and deep strips in accordance with an embodiment of the present invention.

FIG. 10B is an isometric view of a grid 14 according to embodiments of the present invention in which the grid 14 has an irregular surface formed by strips having different depths. The grid 14 can include deep strips 82 and shallow strips 84. The deep strips 82 and shallow strips 84 can alternate in each direction along the grid 14. The strips can alternate in a 1:1 ratio as shown, or can alternate at a different deep/shallow ratio such as 1:2, 1:3, 2:1, 10:1, or any other suitable ratio. In addition, there can be strips of many different depths in the grid 14. In some embodiments, each strip has a unique depth. In other embodiments, the grid 14 includes strips of varying depths in any suitable number or arrangement. At the intersection of any two strips, one strip can have a different depth from the other, or the strips can have the same depth. The thickness of the strips can be uniform between deep strips 82 and shallow strips 84. In other embodiments, some deep strips 82 are thicker and/or longer than the shallow strips 84, or the shallow strips 84 can be thicker and/or longer than the deep strips 82. The irregular surface of the grid 14 can operate similar to the irregular surface of other grid 14 described herein.

Figure 11:
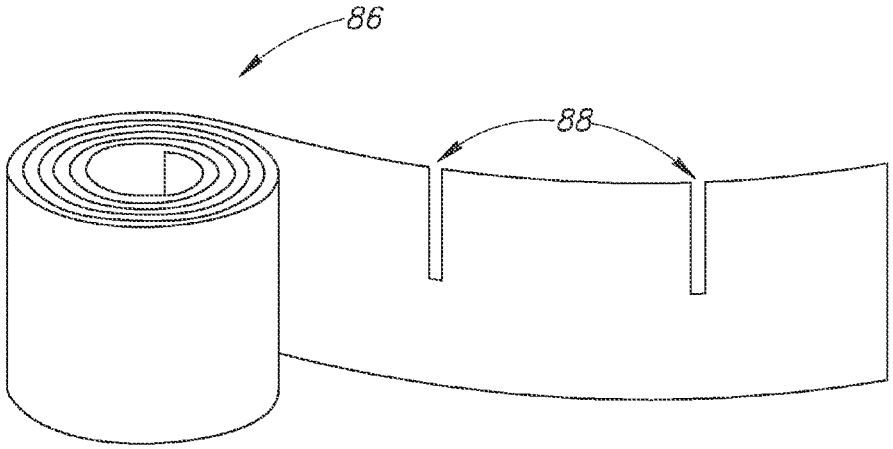
FIG. 11 is a perspective view of a spool of replacement metal strips for use with the protective armor panels of the present invention.

FIG. 11 illustrates a roll of material that can be used to repair a protective armor panel such as those described and illustrated herein. The metal strips can be thin enough to be rolled onto a spool 86 and carried in the field. When the protective armor panel of the several embodiments shown herein is damaged somehow, portions of the armor can be replaced using material from the spool. In some embodiments, the material on the spool 86 can include notches 88 at appropriate intervals to cooperate with existing metal strips in the armor panel. In other embodiments, the metal strips are made of a material that does not bend easily. Accordingly, the metal strips can be maintained in separate, individual strips that can be trimmed to size for repairing the protective armor panel.

Figure 12:
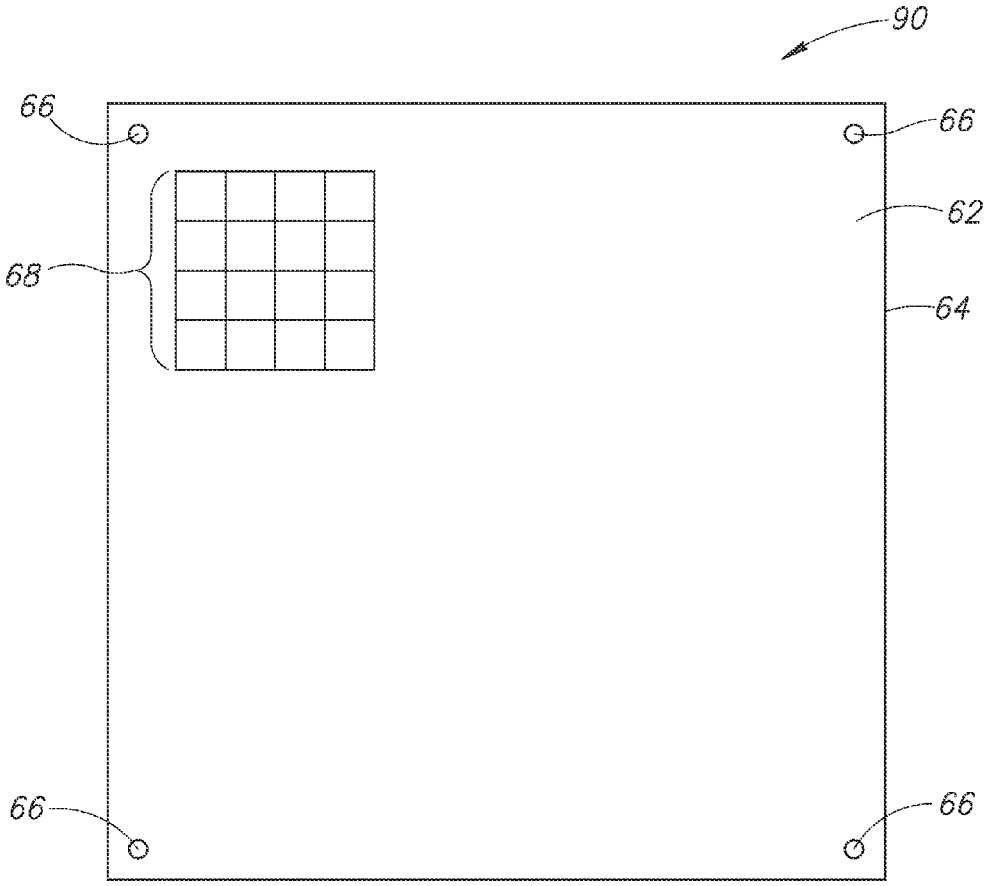
FIG. 12 is a front view of an armor panel having a front sheet with an aperture in accordance with the present invention.

FIG. 12 is a front view of a protective armor panel 90 according to embodiments of the present invention in which the metal grid is partially exposed. The panel 90 can include a metal grid 14 as described above. The panel 90 can also include multiple metal grids, which can be offset from one another. For purposes of explanation, the armor panel 90 has only a single metal grid 14. The panel 90 can include a front sheet 62 and optionally a back sheet 64 that are held to the metal grid 14 by a fastener 66. The front sheet 62 and/or back sheet 64 can include an aperture 68 through which a portion of the metal grid 14 is exposed. The aperture 68 can be of any suitable size and shape, and can be more than one aperture 68. The aperture 68 can be positioned to allow airflow through the armor panel 90 or to allow light (for vision) to pass through the armor panel 90. In some embodiments, the back sheet 64 also has apertures that can be aligned with the apertures 68 on the front sheet 62 to create a direct line of sight and/or airflow through the panel 90. In other embodiments, the apertures can be partially offset to allow a partially direct line of sight, or the apertures can be completely offset with no line of sight through the apertures 68. In embodiments in which the apertures 68 are completely offset, the metal strips of the metal grid 14 can be positioned and/or shaped to allow airflow through the panel 90.

Figure 13:
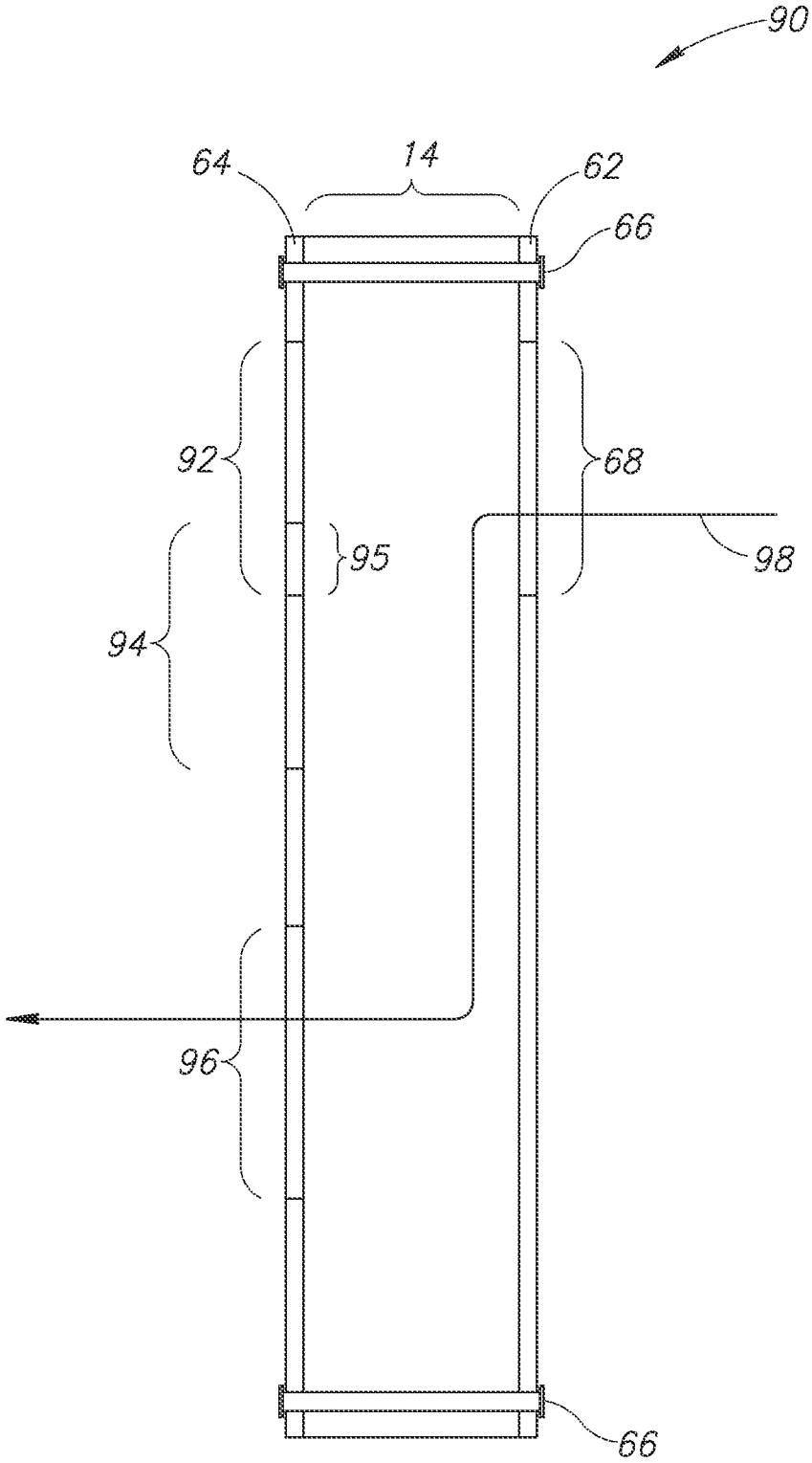
FIG. 13 is a side view of the armor panel of FIG. 11 having a front sheet and a back sheet having apertures in accordance with embodiments of the present invention.

FIG. 13 is a side view of the protective armor panel 90 including the metal grid 14, the front sheet 62, and the back sheet 64 according to embodiments of the present invention. The front sheet 62 has an aperture 68. The back sheet 64 can have an aperture 92 that is substantially aligned with the aperture 68 to allow a direct line of sight through the panel 90 over substantially the entire apertures 68 and 92. The back panel 64 can have an aperture 94 that is partially offset from aperture 68. The apertures 68, 94 overlap partially, but not entirely. In the portion 95 of overlap between the apertures 68 and 94, there is a direct line of sight through the panel 90. The back panel 64 can also include a completely offset aperture 96 which does not overlap with the aperture 68 (or any other aperture in the front panel 62). In some embodiments, the metal strips of the metal grid 14 can be shaped and positioned to allow airflow 98 through the armor panel 90 even through completely offset apertures 68 and 96. For example, the metal strips can have varying depths such as described above in FIGS. 9, 10A, and 10B. Alternatively, the back sheet 64 can be spaced apart from the metal grid 14 by some dimension to allow the air to flow through the panel 90.

The armor panel 90 can include a polymer layer 40 (FIG. 1) that covers the armor panel 90 partially, but not completely, to form apertures in the armor panel 90, similar to apertures 68, 92, 94, and 96. The polymer layer 40 can be molded into virtually any shape, and as such can be molded to include an aperture within the polymer layer 40. In some embodiments, the aperture can be molded to pass directly through the armor panel 90 with a direct line of sight through the panel 90. Alternatively, the aperture can be molded in the polymer layer 40 to have a sinuous or tortuous path through the layer with little or no direct line of sight through the panel 90. The metal strips in the metal grid 14 can be formed to accommodate the molded aperture.

Figure 14A:
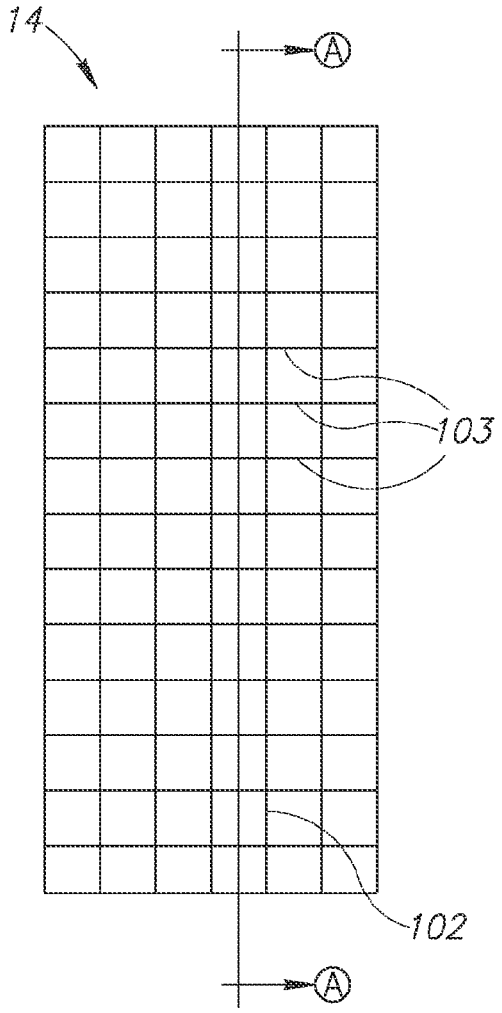
FIG. 14A is a front view of an armor panel in accordance with embodiments of the present invention.
Figure 14B:
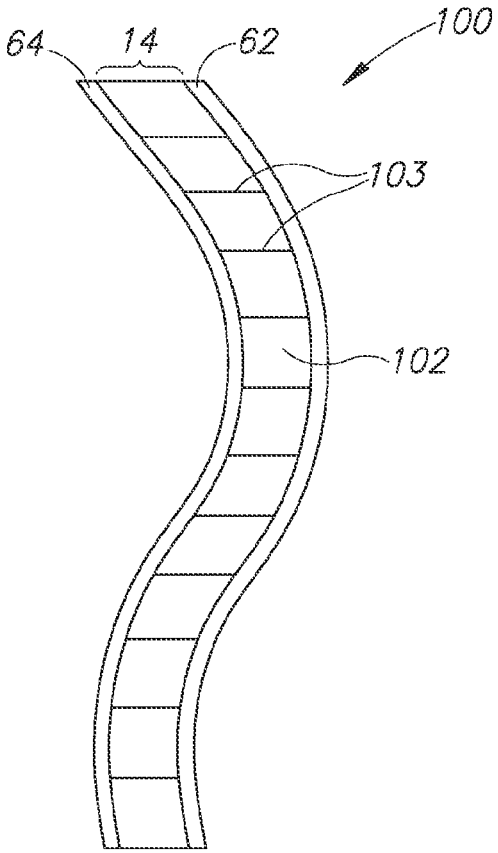
FIG. 14B is a cross-sectional view of the armor panel of FIG. 13A in accordance with embodiments of the present invention.

FIGS. 14A and 14B illustrate a further embodiment of the present invention including a contoured armor panel 100 formed from a metal grid with contoured strips. FIG. 14A is a frontal view of the metal grid 14 of the armor panel 100. FIG. 14B is a cross-sectional view of the armor panel 100 and metal grid 14 taken along line A-A of FIG. 14A. FIG. 14B shows several horizontal strips 103 edgewise and a single vertical strip 102. The strips can be in any orientation and in any angle relative to one another, and is not limited to a grid having horizontal and vertical strips. The armor panel 100 can include a front plate 62 and a back plate 64 on the front and back of the panel 100, respectively. The vertical strip 102 can have a contoured shape. The shape can be virtually any shape and can include convex portions, concave portions, sharp angles, rounded edges, and virtually any suitable shape. The strip 102 can be formed using a water jet cutter or a similar tool, or a press or stamp. The horizontal strips 103 can be straight or contoured. The horizontal strips 103 can be oriented generally parallel, or they can be arranged so that each strip is generally normal to the contoured shape of the vertical strip 102.

In some embodiments, a grid 14 having a front side and a back side can have a contour on the front side and no contour on the back side, or vice versa. For example, an armor panel can be formed to cover a curved object, such as a fender of a vehicle. The side of the grid 14 that faces the fender can have a contour that conforms to or otherwise complements the shape of the fender. The side opposite that faces away from the fender can have a different contour or a flat profile. The differing contours can be achieved by using strips in the grid 14 having different depths at different regions along the armor panel.

The combination of contoured vertical strips 102 and contoured horizontal strips 103 can enable an armor panel 100 having virtually any shape to be produced. For example, the strips can be contoured to form a breastplate for a piece of body armor, or to conform to the rounded shape of a vehicle. The armor panel 100 can be used with a variety of different objects to provide protection from incoming projectiles such as bullets. The armor panel 100 is therefore lightweight and can be made to cover objects of different shape without causing the covered objects to become bulky.

In some embodiments, the strips of the armor panel are flexible to a certain degree to allow for some freedom of movement. In the case of body armor, a breastplate, an arm covering, or a leg covering can be flexible enough to move with the wearer and still provide a high degree of protection to the wearer.

It should be understood that the present disclosure is not limited to the embodiments disclosed herein as such embodiments may vary somewhat. It is also to be understood that the terminology employed herein is used for the purpose of describing particular embodiments only and is not intended to be limiting in scope and that limitations are only provided by the appended claims and equivalents thereof.

What is claimed is:

1. A protective armor panel comprising:

a sheet of material;

a plurality of strips forming a grid operably coupled to the sheet of material, wherein the strips each have a front edge, a back edge, and side faces, the side faces being oriented generally transverse to the sheet of material and the front and back edges being parallel to the sheet of material; and wherein one or more strips include first strips having a first depth, the first depth being a first distance from the front edges to the back edges of the first strips measured perpendicular to the front and back edges of the first strip;

wherein the one or more strips include second strips have a second depth, the second depth being a second distance from the front edges to the back edges of the second strips and measured perpendicular to the front and back edges of the second strips, the second depth being different than the first depth;

wherein the first strips are positioned crosswise to the second strips in a plane parallel to the front and back edges and interlocking with slits defined in the second strips; and wherein the first and second strips have a thickness between the side faces thereof that is less than the first and second depths, the thickness being a third distance from a first side face of the side faces of the each strip of the first and second strips to a second side face of the side faces of the each strip.

2. The protective armor panel of claim 1 wherein the sheet of material comprises at least one of aluminum alloy, titanium, stainless steel, or Kevlar.

3. The protective armor panel of claim 1 wherein the sheet of material is a first sheet of material, the protective armor panel further comprising a second sheet of material positioned opposite the first sheet of material.

4. The protective armor panel of claim 3 wherein the second sheet of material comprises at least one of aluminum alloy, titanium, stainless steel, or Kevlar.

5. The protective armor panel of claim 3 wherein the first sheet of material has an first aperture and the second sheet of material has a second aperture.

6. The protective armor panel of claim 5 wherein the first aperture is aligned with the second aperture.

7. The protective armor panel of claim 5 wherein the first aperture is partially aligned with the second aperture.

8. The protective armor panel of claim 5 wherein the first aperture is offset from the second aperture.

9. The protective armor panel of claim 3 wherein the first sheet of material and the second sheet of material are attached together with a fastener that passes through a portion of the grid.

10. The protective armor panel of claim 3 wherein the fastener comprises one or more of a rivet, a bolt, or a threaded fastener.

11. The protective armor panel of claim 1 wherein the sheet of material partially covers the grid and wherein a portion of the grid is exposed through the sheet of material.

12. The protective armor panel of claim 1 wherein the grid is made from a metal selected from the group consisting an aluminum alloy, titanium and stainless steel.

13. The protective armor panel of claim 1 wherein the strips are contoured.

14. The protective armor panel of claim 13 wherein the grid forms a breastplate.

15. The protective armor panel of claim 13, further comprising a contoured polymer layer forming a sheet, wherein the grid is positioned at least partially within the polymer layer.

16. The protective armor panel of claim wherein the first depth is between ¼ and 1½ inch, and the second depth is between ⅜ inch and ½ inch.

17. The protective armor panel of claim 1 wherein the first depth is larger than the second depth, and wherein the sheet of material includes openings, and further wherein a portion of the strips having the first depth extend through the openings and protrude from the sheet of material.

18. The protective armor panel of claim 1 wherein the first depth is larger than the second depth, and wherein the sheet of material is secured to the portion of the strips having the first depth.

19. A protective armor panel, comprising:

a plurality of strips forming a grid, the strips having a front edge, a back edge opposite the front edge, and side surfaces, wherein the side surfaces are substantially parallel, and wherein the grid has a front side and a back side opposite the front side;

a front plate of titanium secured to the front side of the grid and substantially covering the front side of the grid; and a back plate of Kevlar secured to the back side of the grid and substantially covering the back side of the grid;

wherein each strip of the plurality of strips has both first and second portions, the first and second portions positioned alternating with one another along a length of the front and back edges of the each strip, the first portions of the each strip having a first depth between the front and back edges thereof and the second portions of the each strip being positioned between first portions of the each strip along the front and back edges and having a second depth between the front and back edges thereof, the second depth being greater than the first depth, the first depth of the first portions of the each strip being a first distance from the front edge to the back edge of the first portions of the each strip measured parallel to the side surfaces of the each strip and the second depth of the second portions of the each strip being a second distance from the front edge to the back edge of the second portions of the each strip measured parallel to the side surfaces of the each strip; and wherein the side surfaces are perpendicularly to and extend between the front and back plates and the front and back edges are parallel to the front and back plates, the front edges interfacing with the front plate and the back edges interfacing with the back plate.

20. The protective armor panel of claim 19 wherein the plurality of strips are contoured.

21. The protective armor panel of claim 19 wherein the grid is a first grid, the protective armor panel further comprising a second grid having a plurality of strips, and wherein the plurality of strips in the second grid are offset from the strips in the first grid.

22. The protective armor panel of claim 19 wherein the second portions protrude through the front plate.

23. The protective armor panel of claim 22 wherein the back plate is positioned between the first grid and the second grid.

24. The protective armor panel of claim 21 wherein the strips in the first and second grids are contoured.

25. The protective armor panel of claim 19, further comprising a polymer layer forming a sheet, wherein the grid is positioned at least partially within the polymer layer.

26. A method of manufacturing a protective armor panel, comprising:

forming a plurality of generally thin strips of material having side surfaces, a length, a front edge, a back edge, and a depth;

arranging the strips into a grid with the side surfaces generally parallel and the back edges generally coplanar; and securing a sheet of material to the front edge of the strips; securing a back plate to the back edge of the strips.

27. The method of claim 26 wherein forming the plurality of generally thin strips comprises forming first strips having a first depth and second strips having a second depth different than the first depth.

28. The method of claim 27 wherein arranging the strips into a grid with the back edges generally coplanar comprises arranging the strips into a grid with the front edges of the first strips protruding beyond the front edges of the second strips.

29. The method of claim 26, further comprising securing the front plate to the back plate through the grid.

30. The method of claim 26 wherein forming the plurality of generally thin strips comprises forming a plurality of generally thin strips having a contour.

31. A protective armor panel comprising a plurality of strips each having a front edge, a back edge, and side faces, wherein the strips are arranged in a grid with their side faces generally parallel, the grid having a front side and a back side, wherein the grid is configured to fragment an incoming projectile as the projectile strikes one or more of the strips;

wherein the plurality of strips include first strips having a first depth along the side faces thereof and one or more second strips have a second depth along the side faces thereof, the second depth being different than the first depth, the first depth being a distance from the front edge to the back edge of the first strips measured parallel to the side faces of the first strips and the second depth being a distance from the front edge to the back edge of the second strips measured parallel to the side faces of the second strips; and wherein the first strips are positioned crosswise to and interlocking with the second strips, the second strips defining slits having the first strips inserted in the slits the first and second strips positioned such that the side faces of the first and second strips protrude perpendicular to the front and back sides of the grid and the front and back edges of the first and second strips are parallel to and interface with the front and back sides of the grid.

32. The protective armor panel of claim 31, further comprising a sheet of material secured to the grid.

33. The protective armor panel of claim 32 wherein the sheet of material is a first sheet of material secured to the front side of the protective armor panel, the protective armor panel further comprising a second sheet of material secured to the second side of the protective armor panel.

34. The protective armor panel of claim 32 wherein the sheet of material is made of titanium or Kevlar.

35. The protective armor panel of claim 31 wherein the strips are made of aluminum alloy, titanium, or stainless steel.

36. The protective armor panel of claim 31, further comprising a vehicle having a fluid intake port, wherein the protective armor panel is positioned to at least partially cover the fluid intake port and permit fluid to pass between the strips and into the vehicle.

37. The protective armor panel of claim 31 wherein the strips have a thickness and a depth measured perpendicular to the thickness, and wherein the thickness/depth ratio is between 3.6 and 0.0466.

38. The protective armor panel of claim 31 wherein the strips are made of ballistic grade materials.

39. The protective armor panel of claim 31 wherein the grid is a first grid, the protective armor panel further comprising a second grid generally parallel to the first grid with strips of the second grid offset from strips of the first grid.

40. The protective armor panel of claim 19, wherein the second portions protrude through the front panel.

41. The protective armor panel of claim 19, wherein the front panel sits against the second portions providing a gap between the front plate and the first portions, the gap enabling air flow through the protective armor panel.

* * * * *